US009156128B2

(12) United States Patent
Sakaguchi

(10) Patent No.: US 9,156,128 B2
(45) Date of Patent: Oct. 13, 2015

(54) BURNISHING METHOD AND BURNISHING APPARATUS

(71) Applicant: SHOWA DENKO K.K., Minato-ku, Tokyo (JP)

(72) Inventor: Ryuji Sakaguchi, Chiba (JP)

(73) Assignee: SHOWA DENKO K.K., Tokyo (JP)

( * ) Notice: Subject to any disclaimer, the term of this patent is extended or adjusted under 35 U.S.C. 154(b) by 144 days.

(21) Appl. No.: 13/919,319

(22) Filed: Jun. 17, 2013

(65) Prior Publication Data

US 2013/0344776 A1 Dec. 26, 2013

(30) Foreign Application Priority Data

Jun. 20, 2012 (JP) ..... 2012-138576

(51) Int. Cl.
*B24B 1/00* (2006.01)
*B24B 39/06* (2006.01)

(52) U.S. Cl.
CPC ..... *B24B 39/06* (2013.01)

(58) Field of Classification Search
USPC ..... 451/59, 63, 296, 302, 307
See application file for complete search history.

(56) References Cited

U.S. PATENT DOCUMENTS

| | | | | |
|---|---|---|---|---|
| 5,443,415 | A * | 8/1995 | Shebanow et al. | 451/302 |
| 6,290,573 | B1 * | 9/2001 | Suzuki | 451/8 |
| 2006/0135042 | A1 * | 6/2006 | Frost et al. | 451/5 |
| 2009/0061742 | A1 * | 3/2009 | Okumura et al. | 451/63 |

FOREIGN PATENT DOCUMENTS

| | | | |
|---|---|---|---|
| JP | 9-054943 | A | 2/1997 |
| JP | 11-277339 | A | 10/1999 |
| JP | 2010-267313 | A | 11/2010 |

* cited by examiner

*Primary Examiner* — Lee D Wilson
*Assistant Examiner* — Shantese McDonald
(74) *Attorney, Agent, or Firm* — Sughrue Mion, PLLC

(57) ABSTRACT

An object is to provide a burnishing method in which it is possible to reduce the flying height of a magnetic head by improving the smoothness of the surface of a magnetic disk while suppressing contamination of the magnetic disk due to falling-off or crushing of abrasive grains from a polishing tape.

In the burnishing method, an alignment process of adjusting the position in a thickness direction of a magnetic disk 10 of an outer peripheral plate 75 installed outside an outer peripheral end 10*c* of at least one of the magnetic disk 10 and the magnetic disk 10 so as to make the surface of the outer peripheral plate 75 and the surface of the magnetic disk 10 become flush with each other is performed between a substrate installation process and a burnishing process.

12 Claims, 6 Drawing Sheets

BURNISHING METHOD AND BURNISHING APPARATUS

BACKGROUND OF THE INVENTION

1. Field of the Invention

The present invention relates to a burnishing method and a burnishing apparatus and to a burnishing method which is suitably used when performing surface polishing for finish of a magnetic disk which is used in, for example, a hard disk drive.

Priority is claimed on Japanese Patent Application No. 2012-138576 filed on Jun. 20, 2012, the contents of which are incorporated herein by reference.

2. Description of Related Art

The distance between a magnetic disk and a magnetic head which floats and runs on the magnetic recording surface of the magnetic disk becomes increasingly narrow with an increase in the recording density of the magnetic disk which is used in a hard disk drive. For this reason, it is necessary to reduce the flying height of the magnetic head.

Further, in the past, in a manufacturing process of the magnetic disk, burnishing (polishing treatment) to remove minute dust or projections formed on or stuck to the surface of the magnetic disk has been performed. Since the smoothness of the surface of the magnetic disk is improved by performing the burnishing, the flying height of the magnetic head in the hard disk drive can be further reduced.

As a burnishing method of the related art, for example, a method to press a polishing tape against the surface of the magnetic disk which rotates, by a contact roller, and run the polishing tape with respect to the surface of the magnetic disk can be given (refer to, for example, Japanese Unexamined Patent Application, First Publication No. H11-277339).

Usually, the polishing tape which is used in the burnishing spans between a supply reel and a take-up reel, sequentially supplied from the supply reel, and then taken up by the take-up reel. Then, on the way where the polishing tape runs from the supply reel side to the take-up reel side, the surface (the back surface) on the opposite side to an abrasive grain surface of the polishing tape is pressed by the contact roller, and thus the polishing surface is pressed against the surface of the magnetic disk.

As the polishing tape (a burnishing tape) which is used in the burnishing, usually, a tape made by forming an abrasive layer on a base film made of polyester is used. As an abrasive, chromium oxide, α-alumina, silicon carbide, nonmagnetic iron oxide, diamond, γ-alumina, α,γ-alumina, molten alumina, corundum, artificial diamond, or the like, which has an average particle diameter in a range of 0.05 μm to 50 μm, is used (refer to, for example, Japanese Unexamined Patent Application, First Publication No. H09-054943).

Further, also in Japanese Unexamined Patent Application, First Publication No. 2010-267313, a burnishing process for the surface of the magnetic disk is described. In the burnishing process described in Japanese Unexamined Patent Application, First Publication No. 2010-267313, after a burnishing tape is loaded on a ramp road provided further outside the outermost periphery of the magnetic disk, processing is performed by moving the tape on the surface of the magnetic disk, and thereafter, the tape is unloaded from the ramp road.

SUMMARY OF THE INVENTION

However, in the related arts, if the burnishing is performed in order to reduce the flying height of the magnetic head, there is a problem in that the surface of the magnetic disk is polluted.

According to a study by the inventors of the present invention, in the magnetic disk after the burnishing, alumina particles are included in the pollutant on the surface. Then, it is obvious that the alumina particles which are included in the pollutant are grains fallen off at the time of the burnishing, among the abrasive grains fixed to an abrasive layer of the polishing tape which is used in the burnishing.

Here, occurrence of fallen-off or crushed abrasive grains from the abrasive layer of the polishing tape when performing the burnishing will be described using the drawing.

FIG. 5 is an enlarged cross-sectional view showing an example of a polishing tape after it has been used in burnishing. The polishing tape shown in FIG. 5 has an abrasive layer 160 formed on a support body 120. The abrasive layer 160 has abrasive grains 150, and a binder 60 which binds the abrasive grains 150 to each other and also binds the abrasive grains 150 to the support body 120, as shown in FIG. 5.

If the burnishing is performed by using the polishing tape, an impact is loaded to the abrasive layer 160 due to contact between the polishing tape and the magnetic disk. Due to the impact, the abrasive grain 150 fixed to the abrasive layer 160 is fallen off or crushed (in FIG. 5, a crushed abrasive grain is denoted by reference numeral 70), and is thereby separated from the abrasive layer 160, as shown in FIG. 5. In this way, there is a case where some of the abrasive grains 150 fallen off from the abrasive layer 160 or the crushed abrasive grains 150 sticks to the surface of the magnetic disk, thereby causing the contamination of the surface of the magnetic disk.

In addition, according to a study by the inventors of the present invention, it was found that falling-off or crushing of the abrasive grains fixed to the polishing tape was very likely to occur at a stage near the end of the burnishing. The reason will be described taking a case of performing the burnishing of the related art by using a burnishing apparatus shown in FIGS. 6A to 6D as an example. FIGS. 6A to 6D are enlarged schematic diagrams showing a cross-sectional structure of a burnishing apparatus of the related art which is used in the burnishing.

In a case of performing the burnishing by using the burnishing apparatus shown in FIGS. 6A to 6D, first, as shown in FIG. 6A, chucking of a magnetic disk 61 to a spindle 62 is performed and the magnetic disk 61 is rotated.

Next, as shown in FIG. 6B, a pair of polishing tapes 64 and 64 is disposed so as to sandwich the magnetic disk 61 which rotates, from both sides, and respectively pressed against positions which include an inner peripheral end of the magnetic disk 61 by using contact rollers 63 and 63, whereby the burnishing is started.

Thereafter, as shown in FIG. 6C, the pair of polishing tapes 64 and 64 is relatively moved with respect to each surface of the magnetic disk 61 in a radial direction of the magnetic disk 61 toward the outside from the inside (the center side) of the magnetic disk 61 while being pressed against the surfaces (main surfaces) on both sides of the magnetic disk 61.

Then, as shown in FIG. 6D, the polishing tapes 64 and 64 are relatively moved with respect to the magnetic disk 61 until end portions on the side close to the spindle 62 of the pair of polishing tapes 64 and 64 are located further to the outside than an outer peripheral end 61*a* of the magnetic disk 61. In this way, the polishing tapes 64 and 64 are not brought into contact with the magnetic disk 61, and thus the burnishing is finished.

According to a study by the inventors of the present invention, at the stage near the end of the burnishing, a portion in the width direction of each of the pair of polishing tapes 64 and 64 is in a state of being pressed against the surface of the outer peripheral end 61*a* of the magnetic disk 61. That is, at this stage, only a portion in the width direction of each of the polishing tapes 64 and 64 comes into contact with the magnetic disk 61, and thus a strong force is loaded to only a portion in the width direction of each of the polishing tapes 64 and 64. For this reason, it was found that falling-off or crushing of the abrasive grains 150 fixed to the polishing tapes 64 and 64 was easily generated at the stage near the end of the burnishing, In order to solve this problem, it is conceivable to install a plate-shaped member (hereinafter, the plate-shaped member is referred to as an "outer peripheral plate") further outside the outer peripheral end of the magnetic disk, as shown in Japanese Unexamined Patent Application, First Publication No. 2010-267313. That is, when a portion in the width direction of the polishing tape is pressed against the surface of the outer peripheral end of the magnetic disk, a portion of the polishing tape, which is disposed at a position further on the outside than the outer peripheral end of the magnetic disk, is set to be pressed against the outer peripheral plate. In this way, a strong force which is applied to a portion in the width direction of the polishing tape is relaxed, and thus falling-off or crushing of the abrasive grains fixed to the polishing tape can be prevented.

However, even if the outer peripheral plate is provided outside the magnetic disk, there is a case where it is not possible to sufficiently prevent falling-off or crushing of the abrasive grains from the polishing tape, and thus there is a disadvantage that sufficiently high yield is not obtained. For this reason, it is necessary to further reduce contamination of the surface of the magnetic disk.

The present invention has been made in view of the above-described circumstances and has an object to provide a burnishing method and a burnishing apparatus, in which it is possible to reduce the flying height of a magnetic head by improving the smoothness of the surface of a magnetic disk while effectively suppressing contamination of the magnetic disk due to falling-off or crushing of abrasive grains from a polishing tape.

The inventors of the present invention have conducted earnest efforts and studies in order to solve the above-described problem.

As a result, in a case where a difference in level is formed between the surface of the outer peripheral plate disposed in a burnishing apparatus and the surface of the magnetic disk, even if the outer peripheral plate is provided outside the magnetic disk, it is found that it is not possible to sufficiently prevent falling-off or crushing of the abrasive grains from the polishing tape. That is, if a difference in level is formed between the surface of the outer peripheral plate and the surface of the magnetic disk, since a strong force is applied to the surface of the polishing tape due to the difference in level, falling-off or crushing of the abrasive grains fixed to the polishing tape is easily generated.

Therefore, the inventors of the present invention have repeated a study by focusing on a difference in level between the surface of the outer peripheral plate and the surface of the magnetic disk. Then, it was found that the difference in level was generated in a case where the magnetic disk and/or the outer peripheral plate is not installed correctly at a predetermined position of the burnishing apparatus. As the cause for the magnetic disk and/or the outer peripheral plate not being installed correctly, position deviation when installing the magnetic disk and/or the outer peripheral plate in the burnishing apparatus, position deviation of the outer peripheral plate due to repeated performance of the burnishing, or the like can be given.

Further, in general, the burnishing is continuously performed one by one with respect to a plurality of magnetic disks in order to secure productivity. In this case, the burnishing is continuously performed plural times by the number of magnetic disks. In all of the burnishing which is continuously performed repeatedly plural times, it is difficult to prevent position deviation from occurring when installing the magnetic disk in the burnishing apparatus. Further, usually, in a case where the burnishing is continuously and repeatedly performed a plurality of times, in order to secure productivity, the burnishing is performed in a state where the outer peripheral plate is installed in the burnishing apparatus, without removing the outer mounted peripheral plate, until all of the burnishing is finished. For this reason, in the burnishing which is continuously and repeatedly performed a plurality of times, it is difficult to prevent position deviation from occurring due to wear, degradation, or deformation of the outer peripheral plate, loosening of support means, or the like, because of the performance of burnishing.

For this reason, in a case where the burnishing is continuously performed one by one with respect to a plurality of magnetic disks and the burnishing is performed on one magnetic disk at a time, it is found that it is difficult to prevent falling-off or crushing of the abrasive grains from the lapping tape, especially, due to a difference in level between the surface of the outer peripheral plate and the surface of the magnetic disk, and thus it is not possible to easily improve yield.

Therefore, the inventors of the present invention have repeated a study in order to prevent a difference in level between the surface of the outer peripheral plate and the surface of the magnetic disk in a case of performing the burnishing using the burnishing apparatus in which the outer peripheral plate is disposed at a position on the outside of the outer peripheral end of the magnetic disk. As a result, the inventors have found that by performing an alignment process of making the surface of the outer peripheral plate and the surface of the magnetic disk become flush with each other after the magnetic disk is supported in the burnishing apparatus and before the burnishing is performed, it is possible to prevent falling-off or crushing of the abrasive grains fixed to the polishing tape, as shown below, and conceived of the invention.

That is, in a case that the alignment process is performed, the burnishing is performed in a state that the surface of the outer peripheral plate is coplanar with the surface of the magnetic disk. For this reason, when the polishing tape is pressed against the outer peripheral end of the magnetic disk in the burnishing, the polishing tape is pressed against the surface of the outer peripheral plate which is flush with the surface of the magnetic disk, as well as the outer peripheral end of the magnetic disk. Therefore, substantially uniform forces are loaded to a portion pressed against the outer peripheral end of the magnetic disk in the polishing tape and a portion pressed against the outer peripheral plate in the polishing tape, and thus falling-off or crushing of the abrasive grains due to a strong force being applied to a portion of the polishing tape can be effectively prevented.

In addition, in the invention, a "state where the surface of the outer peripheral plate and the surface of the magnetic disk become flush with each other" means a state where position deviation in a thickness direction of the magnetic disk between the surface of the outer peripheral plate and the surface of the magnetic disk is ±45 μm, that is, greater than or equal to −45 μm and less than or equal to 45 μm and the deviation is close to 0 μm in the available range.

That is, the invention has the following configurations.

(1) A burnishing method including: a substrate installation process of making a magnetic disk be supported on rotary support means for rotatably supporting the magnetic disk; and a burnishing process of relatively moving a polishing tape in a radial direction of the magnetic disk while pressing the polishing tape against the surfaces of the magnetic disk which rotates, in which an alignment process of adjusting the position in a thickness direction of the magnetic disk of an outer peripheral plate installed outside an outer peripheral end of the magnetic disk and/or the magnetic disk so as to make the surface of the outer peripheral plate be on the same level with the surface of the magnetic disk is performed between the substrate installation process and the burnishing process.

(2) The burnishing method of a magnetic disk according to the above (1), wherein burnishing of a plurality of magnetic disks is continuously performed one by one by repeatedly performing the substrate installation process a plurality of times, the alignment process, and the burnishing process in this order.

(3) The burnishing method according to the above (1) or (2), wherein in the burnishing process, the polishing tape is separated from the magnetic disk by moving the polishing tape onto the outer peripheral plate.

(4) A burnishing apparatus including: rotary support means for rotatably supporting a magnetic disk; an outer peripheral plate disposed at a position on the outside of an outer peripheral end of the magnetic disk supported on the rotary support means; tape moving means for relatively moving a polishing tape in a radial direction of the magnetic disk while pressing the polishing tape against the surface of the magnetic disk which rotates; and alignment means for adjusting the position in a thickness direction of the magnetic disk of the outer peripheral plate and/or the magnetic disk so as to make the surface of the outer peripheral plate and the surface of the magnetic disk become flush with each other.

(5) The burnishing apparatus according to the above (4), wherein the alignment means adjusts the position in the thickness direction of the magnetic disk of the outer peripheral plate and/or the magnetic disk every time the magnetic disk is supported on the rotary support means.

(6) The burnishing apparatus according to the above (4) or (5), wherein the alignment means moves the outer peripheral plate and/or the magnetic disk in a range of ±45 μm in the thickness direction of the magnetic disk so as to make the surface of the outer peripheral plate and the surface of the magnetic disk become flush with each other.

(7) The burnishing apparatus according to any one of the above (4) to (6), wherein the surface of the outer peripheral plate is formed of any of glass, stainless steel, and a ceramic material, each having the same roughness as the magnetic disk.

(8) The burnishing apparatus according to any one of the above (4) to (7), wherein the outer peripheral plate is detachably supported.

(9) The burnishing apparatus according to any one of the above (4) to (8), wherein the outer peripheral plate is disposed at a position where the shortest distance between the outer peripheral plate and the outer peripheral end of the magnetic disk is less than or equal to 10 mm.

(10) The burnishing apparatus according to any one of the above (4) to (9), wherein the tape moving means includes a pair of polishing tape pressing means and a pair of polishing tape running systems, each disposed to face each other so as to sandwich the magnetic disk from both sides through the polishing tape.

According to the burnishing method and the burnishing apparatus related to the invention, it is possible to perform the burnishing with high yield while suppressing the contamination of the magnetic disk due to falling-off or crushing of the abrasive grains from the polishing tape and it is possible to reduce the flying height of the magnetic head by improving the smoothness of the surface of the magnetic disk.

DETAILED DESCRIPTION OF THE INVENTION

Hereinafter, a burnishing method and a burnishing apparatus according to the invention will be described in detail using the drawings.

The invention relates to a burnishing method and a burnishing apparatus, which are used in surface polishing for finish when manufacturing a magnetic recording medium (a magnetic disk). More specifically, the invention relates to a method of smoothing the surface of a magnetic disk by removing minute dust or projections which are present on the surface of the magnetic disk by relatively sliding a polishing tape against the surface of the magnetic disk.

Hereinafter, a work-piece in the invention is simply referred to as a magnetic disk.

The magnetic disk which is subjected to burnishing in the invention may be either an unfinished article or a finished product (a magnetic recording medium) in a manufacturing process of an in-plane magnetic disk or a vertical magnetic disk. Further, the magnetic disk which is subjected to burnishing in the invention may be either an unfinished article or a finished product (a magnetic recording medium) in a manufacturing process of a discrete disk or a bit pattern disk.

(Polishing Tape)

First, a polishing tape which is used in the burnishing method and the burnishing apparatus according to the invention will be described.

Figure 1:
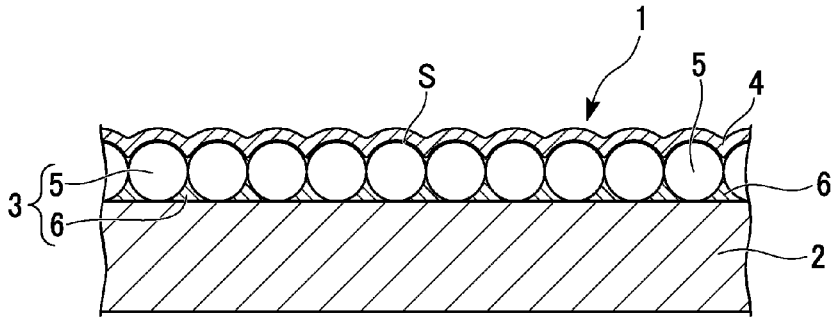
FIG. 1 is an enlarged cross-sectional view showing an example of a polishing tape which is used in the invention.

FIG. 1 is an enlarged cross-sectional view showing an example of the polishing tape which is used in the invention. A polishing tape 1 shown in FIG. 1 is for polishing the magnetic disk by sliding a polishing surface S with respect to the surface of the magnetic disk.

The polishing tape 1 shown in FIG. 1 has an abrasive layer 160 formed on a support body 2. The abrasive layer 160 has abrasive grains 5, and a binder 6 which binds the abrasive grains 5 to each other and also binds the abrasive grains 5 to the support body 2, as shown in FIG. 1.

As a material configuring the support body 2, it is not particularly limited and various resins such as polyethylene terephthalate, or the like is used.

The abrasive layer 160 has irregularities that reflect the particle shapes of the abrasive grains 5 in the surface thereof, as shown in FIG. 1.

As the abrasive grain 5, for example, a particle made of chromium oxide, α-alumina, silicon carbide, nonmagnetic iron oxide, diamond, γ-alumina, α,γ-alumina, molten alumina, corundum, artificial diamond, or the like can be given, and one type or two or more types of these can also be used in appropriate combination.

As the binder 6, it is not particularly limited, and for example, either of thermosetting resin, thermoplastic resin, photosensitive resin, or the like can be used. As for the resin that is used as the binder 6, one kind may be used alone and two or more kinds may also be used in combination.

As the thermosetting resin that is used in the binder 6, for example, urea resin, melamine resin, phenol resin, epoxy resin, unsaturated polyester resin, alkyd resin, urethane resin, or the like can be given.

As the thermoplastic resin that is used in the binder 6, for example, acrylonitrile butadiene styrene (ABS) resin, butadiene styrene resin, polybutadiene resin, acrylic rubber-based MBS resin, or the like can be given.

As the photosensitive resin that is used in the binder 6, for example, methacrylic resin, phenol resin, urea resin, melamine resin, polystyrene resin, polyacetal resin, polycarbonate resin, epoxy resin, or the like can be given.

The polishing tape 1 shown in FIG. 1 may be a polishing tape in which the surface of the abrasive layer 3 is covered with a liquid lubrication layer 4. The liquid lubrication layer 4 has the effect of stabilizing a shear force (dynamic friction coefficient) which is generated between the surface of the magnetic disk and the surface of the polishing tape 1, thereby even more suppressing falling-off of the abrasive grain 5, in a burnishing process.

As a liquid lubricant that is used in the liquid lubrication layer 4, it is not particularly limited. However, a liquid lubricant which contains a compound having a perfluoropolyether structure is preferable. If the surface of the abrasive layer 3 is covered with the liquid lubrication layer 4, in the burnishing process, there is a case where the liquid lubricant is transferred to the magnetic disk. The compound having a perfluoropolyether structure is generally used as a lubricant which is applied to the surface of the magnetic disk. Therefore, in a case where the liquid lubrication layer 4 is the compound having a perfluoropolyether structure, there is an advantage that even if the liquid lubricant of the polishing tape 1 is transferred to the magnetic disk, a problem does not arise.

(Magnetic Disk)

Figure 2:
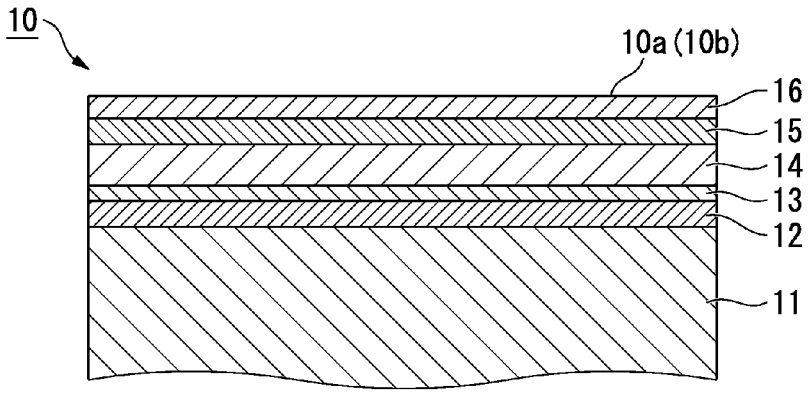
FIG. 2 is an enlarged cross-sectional view showing an example of a magnetic disk which is applied in the invention.

Next, an example of the magnetic disk to which the burnishing method and the burnishing apparatus according to the invention is applied will be described referring to FIG. 2. FIG. 2 is a cross-sectional view showing an example of the magnetic disk which is applied in the invention and is an enlarged cross-sectional view showing a side of the main surface on one side of the magnetic disk.

A magnetic disk 10 shown in FIG. 2 is a magnetic disk in which a soft magnetic foundation layer 12, an orientation control layer 13, a magnetic layer 14, a protective layer 15, and a lubricant layer 16 are sequentially laminated on each of both surfaces (the main surface on one side and the main surface on the other side) of a nonmagnetic substrate 11.

<Nonmagnetic Substrate>

As the nonmagnetic substrate 11, a substrate or the like can be used in which a film made of NiP or a NiP alloy is formed on a base body made of metal or an alloy material such as Al or an Al alloy. Further, as the nonmagnetic substrate 11, a substrate made of a nonmetal material such as glass, ceramics, silicon, silicon carbide, carbon, or resin may be used, and a substrate in which a NiP or NiP alloy film is formed on a base body made of the nonmetal material may also be used.

(Close-Contact Layer)

It is preferable that a close-contact layer be provided between the nonmagnetic substrate 11 and the soft magnetic foundation layer 12 in order to prevent corrosion of the nonmagnetic substrate 11 in a case where the nonmagnetic substrate 11 and the soft magnetic foundation layer 12 are disposed in contact with each other. As a material of the close-contact layer, for example, Cr, a Cr alloy, Ti, a Ti alloy, or the like can be appropriately selected. It is preferable that the thickness of the close-contact layer be greater than or equal to 2 nm such that the effect due to providing the close-contact layer can be sufficiently obtained.

The close-contact layer can be formed by, for example, a sputtering method.

<Soft Magnetic Foundation Layer>

It is preferable that the soft magnetic foundation layer 12 have a structure in which a first soft magnetic film, an intermediate layer made of a Ru film, and a second soft magnetic film are laminated in sequence. That is, it is preferable that the soft magnetic foundation layer 12 have a structure in which the intermediate layer made of a Ru film is sandwiched between the soft magnetic films of two layers, whereby the soft magnetic films on the top and bottom of the intermediate layer are bonded together by an Anti-Ferro-Coupling (AFC). The soft magnetic foundation layer 12 has an AFC-bonded structure, whereby the resistance to a magnetic field from the outside and the resistance to a WATE (Wide Area Track Erasure) phenomenon that is a problem peculiar to vertical magnetic recording can be enhanced.

It is preferable that the film thickness of the soft magnetic foundation layer 12 be in a range of greater than or equal to 15 nm and less than or equal to 80 nm and it is more preferable that the film thickness be in a range of greater than or equal to 20 nm and less than or equal to 50 nm. If the film thickness of the soft magnetic foundation layer 12 is less than 15 nm, it is not preferable because it is not possible to sufficiently absorb magnetic flux from a magnetic head, and thus there is a concern that writing may become incomplete and the recording and reproducing characteristics may deteriorate. On the other hand, if the film thickness of the soft magnetic foundation layer 12 exceeds 80 nm, it is not preferable because the productivity is significantly reduced.

It is preferable that the first and second soft magnetic films be made of a CoFe alloy. In a case where the first and second soft magnetic films are made of a CoFe alloy, a high saturation magnetic flux density Bs (greater than or equal to 1.4 T) can be realized.

Further, it is preferable that any of Zr, Ta, and Nb be added to the CoFe alloy which is used in the first and second soft magnetic films. In this way, amorphization of the first and second soft magnetic films is promoted, and it thus becomes possible to improve the orientation of a seed layer and it also becomes possible to reduce the flying height of the magnetic head.

The soft magnetic foundation layer 12 can be formed by a sputtering method.

(Seed Layer)

The seed layer is used to control the orientation or the crystal size of the orientation control layer 13 and the magnetic layer 14 provided thereon. The seed layer is provided in order to make a vertical component with respect to the substrate surface of the magnetic flux which is generated from the magnetic head large and also more solidly fix the direction of magnetization of the magnetic layer 14 in a direction perpendicular to the nonmagnetic substrate 11. For this reason, it is preferable that the seed layer be provided under the orientation control layer 13.

It is preferable that the seed layer be made of a NiW alloy. In a case where the seed layer is made of a NiW alloy, another element such as B, Mn, Ru, Pt, Mo, or Ta may be added to the NiW alloy, as necessary.

It is preferable that the film thickness of the seed layer be in a range of greater than or equal to 2 nm and less than or equal to 20 nm. If the film thickness of the seed layer is less than 2 nm, it may not be sufficiently obtained the effect to form the seed layer. On the other hand, if the film thickness of the seed layer exceeds 20 nm, it is not preferable because the crystal size becomes large.

The seed layer can be formed by a sputtering method.

<Orientation Control Layer>

The orientation control layer 13 is used to perform control such that orientation of the magnetic layer 14 becomes favorable. It is preferable that the orientation control layer 13 be made of Ru or a Ru alloy.

It is preferable that the film thickness of the orientation control layer 13 be in a range of greater than or equal to 5 nm and less than or equal to 30 nm. By making the film thickness of the orientation control layer 13 be less than or equal to 30 nm, the distance between the magnetic head and the soft magnetic foundation layer 12 becomes small, and thus it is possible to make the magnetic flux from the magnetic head steep. Further, by making the film thickness of the orientation control layer 13 be greater than or equal to 5 nm, it is possible to favorably control the orientation of the magnetic layer 14.

The orientation control layer 13 may be made of a single layer or a plurality of layers. In a case where the orientation control layer 13 is made of a plurality of layers, all the layers of the orientation control layer 13 may be made of the same material and some layers may be made of different materials from other layers.

The orientation control layer 13 may be formed by a sputtering method.

<Magnetic Layer>

The magnetic layer 14 is made of a magnetic film with an axis of easy magnetization directed in a vertical direction with respect to the surface of the substrate. The magnetic layer 14 contains Co and Pt and may further contain an oxide, Cr, B, Cu, Ta, Zr, or the like in order to improve the SNR (signal-to-noise ratio) characteristics.

As the oxide which is contained in the magnetic layer 14, $SiO_2$, SiO, $Cr_2O_3$, CoO, $Ta_2O_3$, $TiO_2$, or the like may be used.

The magnetic layer 14 may be made of a single layer and may also be made of a plurality of layers made of materials having different compositions.

For example, in a case where the magnetic layer 14 is made of three layers, a first magnetic layer, a second magnetic layer, and a third magnetic layer, it is preferable that the first magnetic layer have a granular structure made of a material containing Co, Cr, and Pt and further containing an oxide. As the oxide which is contained in the first magnetic layer, it is preferable to use an oxide of Cr, Si, Ta, Al, Ti, Mg, Co, or the like, for example. Among them, especially, $TiO_2$, $Cr_2O_3$, $SiO_2$, or the like can be suitably used. Further, it is preferable that the first magnetic layer be made of a composite oxide with two or more kinds of oxides added thereto. Among them, especially, $Cr_2O_3$—$SiO_2$, $Cr_2O_3$—$TiO_2$, $SiO_2$—$TiO_2$, or the like can be suitably used.

The first magnetic layer can contain one or more kinds of elements which are selected from B, Ta, Mo, Cu, Nd, W, Nb, Sm, Tb, Ru, and Re, in addition to Co, Cr, Pt, and oxides. The first magnetic layer contains some of the above elements, whereby it is possible to promote refining of a magnetic particle or improve the crystallinity or orientation thereof, and thus it is possible to obtain recording and reproducing characteristics and thermal fluctuation characteristics, which are suitable for higher density recording.

The same material as the first magnetic layer can be used in the second magnetic layer. It is preferable that the second magnetic layer have a granular structure.

Further, it is preferable that the third magnetic layer have a non-granular structure made of a material which contains Co, Cr, and Pt and does not contain an oxide. The third magnetic layer can contain one or more kinds of elements which are selected from B, Ta, Mo, Cu, Nd, W, Nb, Sm, Tb, Ru, Re, and Mn, in addition to Co, Cr, and Pt. The third magnetic layer contains the above elements in addition to Co, Cr, and Pt, whereby it is possible to promote refining of a magnetic particle or to improve the crystallinity or orientation, and thus it is possible to obtain the recording and reproducing characteristics and the thermal fluctuation characteristics, which are suitable for higher density recording.

It is preferable that the thickness of the magnetic layer 14 be greater than or equal to 5 nm and less than or equal to 25 nm. If the thickness of the magnetic layer 14 is less than 5 nm, sufficient reproduction output is not obtained and there is a reduction in the thermal fluctuation characteristics. Further, in a case where the thickness of the magnetic layer 14 exceeds 25 nm, it is not preferable because enlargement of a magnetic particle in the magnetic layer 14 occurs, noise at the time of recording and reproduction increases, and thus the recording and reproducing characteristic which is represented by a signal/noise ratio (S/N ratio) or a recording property (OW) deteriorates.

Further, in a case where the magnetic layer 14 is made of a plurality of layers, it is preferable to provide a nonmagnetic layer between adjacent magnetic layers. In a case where the magnetic layer 14 is made of three layers, the first magnetic layer, the second magnetic layer, and the third magnetic layer, it is preferable to provide nonmagnetic layers between the first magnetic layer and the second magnetic layer and between the second magnetic layer and the third magnetic layer.

By providing the nonmagnetic layer between the magnetic layers at a moderate thickness, magnetization reversal of the individual films becomes easy, it is possible to reduce dispersion of magnetization reversal of all the magnetic particles, and it is possible to further improve the S/N ratio.

As for the nonmagnetic layer which is provided between the magnetic layers, for example, Ru, a Ru alloy, a CoCr alloy, a CoCrX1 alloy (X1 represents at least one kind or two or more kinds of elements which are selected from Pt, Ta, Zr, Re, Ru, Cu, Nb, Ni, Mn, Ge, Si, O, N, W, Mo, Ti, V, and B), or the like can be suitably used.

Further, as for the nonmagnetic layer which is provided between the magnetic layers, it is preferable to use an alloy material including an oxide, a metal nitride, or a metal carbide. Specifically, as the oxide, for example, $SiO_2$, $Al_2O_3$, $Ta_2O_5$, $Cr_2O_3$, MgO, $Y_2O_3$, $TiO_2$, or the like can be used, as the metal nitride, for example, AlN, $Si_3N_4$, TaN, CrN, or the like can be used, and as the metal carbide, for example, TaC, BC, SiC, or the like, can be used.

It is preferable that the thickness of the nonmagnetic layer which is provided between the magnetic layers be greater than or equal to 0.1 nm and less than or equal to 1 nm. By making the thickness of the nonmagnetic layer be in the above range, it is possible to further improve the S/N ratio.

The nonmagnetic layer can be formed by a sputtering method.

Further, it is preferable that the magnetic layer 14 be a magnetic layer for vertical magnetic recording with an axis of easy magnetization directed in a vertical direction with respect to the surface of the substrate, in order to realize higher recording density. However, in-plane magnetic recording is also acceptable.

The magnetic layer 14 may be formed by any known method in the related art, such as a vapor deposition method, an ion beam sputtering method, or a magnetron sputtering method. However, usually, the magnetic layer 14 is formed by a sputtering method.

<Protective Layer>

As the protective layer 15, a carbon-based material such as CVD carbon which is formed by a plasma CVD method, amorphous carbon, hydrogenous carbon, nitrogenous carbon, or fluorine-containing carbon, or a ceramic-based material such as silica or zirconia can be appropriately selected and used. Among them, the CVD carbon which is hard and dense is suitably used in terms of not only durability, but also economic efficiency, productivity, or the like.

<Lubricant Layer>

As a material of the lubricant layer 16 that is the uppermost layer, a polymer of a polymerizable unsaturated group-containing perfluoropolyether compound is suitable. As the polymerizable unsaturated group-containing perfluoropolyether compound, for example, a compound in which an organic group having a polymerizable unsaturated bond is bonded to at least one end of perfluoropolyether that is a main chain, or the like, can be given.

(Burnishing Apparatus)

Figure 3A:
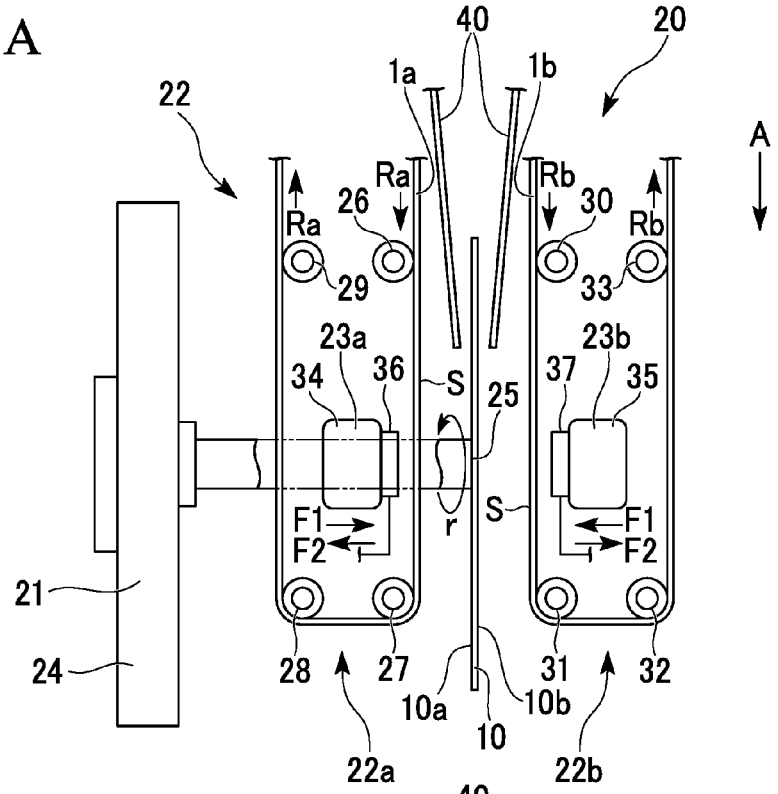
FIGS. 3A and 3B are schematic diagrams for describing an example of a burnishing apparatus according to the invention.
Figure 3B:
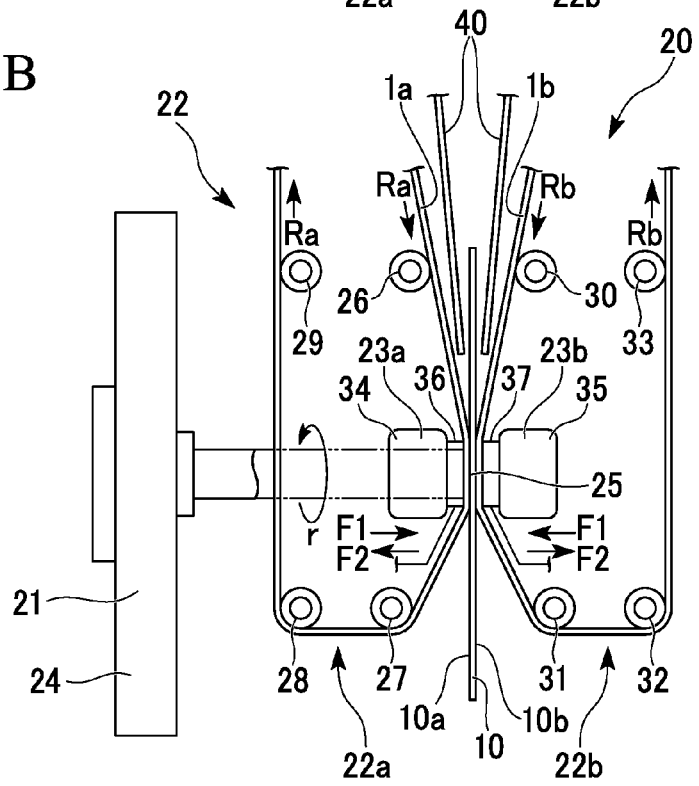

Next, an example of the burnishing apparatus according to the invention will be described with reference to FIGS. 3A, 3B, and 4A to 4E. FIGS. 3A and 3B are schematic diagrams for describing an example of the burnishing apparatus according to the invention. FIGS. 4A to 4E are enlarged horizontal cross-sectional schematic diagrams when the burnishing apparatus shown in FIGS. 3A and 3B is viewed from a direction of an arrow A shown in FIG. 3A, and FIGS. 3A and 3B are vertical cross-sectional views as viewed from a direction of an arrow B shown in FIG. 4A.

A burnishing apparatus 20 shown in FIGS. 3A and 3B includes rotary support means 21 for the magnetic disk 10, an outer peripheral plate, a tape moving means 22, and an alignment means.

As shown in FIGS. 3A and 3B, the rotary support means 21 is for rotatably supporting the magnetic disk 10 and includes a spindle 24 which is rotationally driven by a spindle motor (not shown), and a magnetic disk retaining mechanism 25 mounted on the center of the spindle 24. On the magnetic disk retaining mechanism 25, the magnetic disk 10 is retained and the center of the magnetic disk 10 is mounted. If the spindle 24 is rotationally driven in a state where the magnetic disk 10 is retained on the magnetic disk retaining mechanism 25, the magnetic disk 10 is rotated according to a rotation direction and the number of rotations of the spindle 24.

In addition, the rotary support means 21 is configured so as to rotate the magnetic disk 10 in a rotation direction (a direction of an arrow r in FIGS. 3A and 3B) in which a scanning direction of a track of the magnetic disk 10 that rotates becomes the opposite direction to a running direction (a direction of an arrow Ra in FIGS. 3A and 3B) of a first polishing tape 1*a* and a running direction (a direction of an arrow Rb in FIGS. 3A and 3B) of a second polishing tape 1*b*.

Further, the burnishing apparatus 20 shown in FIGS. 3A and 3B has the first polishing tape 1*a* which runs such that the polishing surface S thereof faces a main surface 10*a* on one side of the magnetic disk 10, and the second polishing tape 1*b* which runs such that the polishing surface S thereof faces a main surface 10*b* on the other side of the magnetic disk 10. As each of the polishing tapes 1*a* and 1*b*, the long polishing tape 1 shown in FIG. 1 is used.

An outer peripheral plate 75 is disposed by being supported by an outer peripheral plate support means 78, at a position on the outside of an outer peripheral end 10*c* of the magnetic disk 10 supported on the rotary support means, as shown in FIGS. 4A to 4E.

It is preferable that the outer peripheral plate 75 be disposed at a position where the shortest distance between the outer peripheral end 10*c* of the magnetic disk 10 and the outer peripheral plate 75 is as short as possible not to touch each other, it is more preferable that the shortest distance is greater than or equal to 0.2 mm. In this case, mounting and dismounting of the magnetic disk 10 can be easily and efficiently performed without coming into contact with the outer peripheral plate 75.

Further, it is preferable that the outer peripheral plate 75 be disposed at a position where the shortest distance between the outer peripheral end 10*c* of the magnetic disk 10 and the outer peripheral plate 75 is less than or equal to 10 mm, it is more preferable that the outer peripheral plate 75 be disposed at a position where the shortest distance is less than or equal to 5 mm, and most preferably, the outer peripheral plate 75 is disposed at a position where the shortest distance is less than or equal to 1 mm. In a case where the shortest distance is less than or equal to 10 mm, alignment between the surface of the outer peripheral plate 75 and the surface of the magnetic disk 10 can be performed with a high degree of accuracy. Further, in a case where the shortest distance is less than or equal to 10 mm, the distance between the outer peripheral plate 75 and the magnetic disk 10 is sufficiently near. Accordingly, when the polishing tapes 1*a* and 1*b* are pressed against the outer peripheral end 10*c* of the magnetic disk 10, forces which are loaded to the polishing tapes 1*a* and 1*b* of a portion pressed against the outer peripheral end 10*c* of the magnetic disk 10 and a portion pressed against the outer peripheral plate 75 become even more uniform. Therefore, falling-off or crushing of the abrasive grains due to a strong force being applied to a portion of each of the polishing tapes 1*a* and 1*b* can be more effectively prevented.

Further, in the burnishing apparatus 20 shown in FIGS. 3A and 3B, the outer peripheral plate 75 is detachably supported by the outer peripheral support means 78. Therefore, in the burnishing apparatus 20 shown in FIGS. 3A and 3B, it is possible to replace the outer peripheral plate 75, as necessary.

Further, it is preferable that the surface of the outer peripheral plate 75 be formed of any of glass, stainless steel, and a ceramic material, each having the same roughness as the magnetic disk 10, and it is more preferable that the outer peripheral plate 75 be made of the same material as the nonmagnetic substrate 11 of the magnetic disk 10. That is, it is preferable that a surface property of the outer peripheral plate 75 and a surface property of the magnetic disk 10 which is subjected to burnishing as approximate to each other as possible. The more the surface properties of the outer peripheral plate 75 and the magnetic disk 10 approximate each other, the more uniform the force which is loaded to the portion pressed against the outer peripheral end 10*c* of the magnetic disk 10, of the polishing tapes 1*a* and 1*b*, and the force which is loaded to the portion pressed against the outer peripheral plate 75, of the polishing tapes 1*a* and 1*b*, become, and thus falling-off or crushing of the abrasive grains can be suppressed.

Further, it is preferable that the outer peripheral plate 75 have high flatness so as to be able to suppress falling-off or crushing of the abrasive grains even more by making the forces that are loaded to the polishing tapes 1*a* and 1*b* of portions pressed against the outer peripheral plate 75 uniform.

Further, in the burnishing apparatus 20 shown in FIGS. 3A and 3B, the outer peripheral plate 75 has the same thickness as the magnetic disk 10. In this way, in the burnishing apparatus 20 shown in FIGS. 3A and 3B, it is possible to perform alignment such that the front surface and the back surface of the magnetic disk 10 respectively become flush with the front surface and the back surface of the outer peripheral plate 75. Therefore, in the burnishing apparatus 20 shown in FIGS. 3A and 3B, the polishing tapes 1*a* and 1*b* can be disposed to face each other so as to sandwich the magnetic disk 10 from both sides. Therefore, according to the burnishing apparatus 20 shown in FIGS. 3A and 3B, it is possible to efficiently perform the burnishing with high yield at the same time with respect to both surfaces of the magnetic disk 10 while suppressing contamination of the magnetic disk 10 due to falling-off or crushing of the abrasive grains from the polishing tapes 1*a* and 1*b*.

Further, the alignment means is for adjusting the position in a thickness direction of the magnetic disk 10 of the outer peripheral plate 75 and/or the magnetic disk 10 so as to make the surface of the outer peripheral plate 75 and the surface of the magnetic disk 10 become flush with each other.

In the burnishing apparatus 20 shown using FIGS. 3A, 3B, and 4A to 4E, the outer peripheral plate support means 78 and the rotary support means 21 are made to double as the alignment means.

That is, the outer peripheral plate support means 78 is made to be movable in a thickness direction (a direction of an arrow C shown in FIG. 4A) of the outer peripheral plate 75 in a state of supporting the outer peripheral plate 75.

Further, the outer peripheral plate support means 78 is made to be movable in a range of ±500 μm, that is, greater than or equal to −500 μm and less than or equal to 500 μm, preferably, ±100 μm, that is, greater than or equal to −100 μm and less than or equal to 100 μm, most preferably, ±45 μm, that is, greater than or equal to −45 μm and less than or equal to 45 μm, in order to adjust the position of the outer peripheral plate 75 at high speed in the thickness direction (the direction of the arrow C) of the magnetic disk 10. Due to these conditions, the surface of the outer peripheral plate 75 and the surface of the magnetic disk 10 become flush with each other.

Further, the rotary support means 21 may be movable in the thickness direction of the magnetic disk 10 in a state of supporting the magnetic disk 10. The rotary support means 21 in this case moves the magnetic disk 10 in a range of, preferably, ±100 μm, that is, greater than or equal to −100 μm and less than or equal to 100 μm, more preferably, ±80 μm, that is, greater than or equal to −80 μm and less than or equal to 80 μm, most preferably, ±45 μm, that is, greater than or equal to −45 μm and less than or equal to 45 μm in the thickness direction of the magnetic disk 10, thereby making the surface of the outer peripheral plate 75 and the surface of the magnetic disk 10 become flush with each other.

In a case where a plurality of magnetic disks 10 is continuously subjected to the burnishing one by one, there is a concern that position deviation when installing the magnetic disk 10 in the burnishing apparatus 20 or position deviation according to wear, degradation, or deformation of the outer peripheral plate 75, loosening of the support means, or the like may occur.

However, the outer peripheral plate support means 78 and the rotary support means 21, which also serve as the alignment means, adjust the position in the thickness direction of the magnetic disk 10 of the outer peripheral plate 75 and/or the magnetic disk 10 every time the magnetic disk 10 is supported on the rotary support means 21.

Therefore, even if the above-described position deviation occurs, by adjusting the position in the thickness direction of the magnetic disk 10 of the outer peripheral plate 75 and/or the magnetic disk 10 by the alignment means, it is possible to eliminate a difference in level between the surface of the outer peripheral plate 75 and the surface of the magnetic disk 10. Therefore, it is possible to prevent falling-off or crushing of the abrasive grains from the polishing tapes 1*a* and 1*b* due to a difference in level between the surface of the outer peripheral plate 75 and the surface of the magnetic disk 10, and thus it is possible to improve the yield.

Further, the outer peripheral plate support means 78 and the rotary support means 21 can move the outer peripheral plate 75 and/or the magnetic disk 10 in a range of ±500 μm, that is, greater than or equal to −500 μm and less than or equal to 500 μm, preferably, in a range of ±100 μm, that is, greater than or equal to −100 μm and less than or equal to 100 μm, most preferably, in a range of ±45 μm, that is, greater than or equal to −45 μm and less than or equal to 45 μm, in the thickness direction of the magnetic disk 10. In addition, a moving range in the thickness direction of the magnetic disk 10 of the outer peripheral plate 75 and/or the magnetic disk 10 can be appropriately determined according to chucking accuracy or the like of the magnetic disk 10 in the spindle 24.

It is preferable that outer peripheral plate support means 78 and the rotary support means 21 can move the outer peripheral plate 75 and/or the magnetic disk 10 in a range of ±45 μm, that is, greater than or equal to −45 μm and less than or equal to 45 μm, in the thickness direction of the magnetic disk 10. In this case, a moving range of the outer peripheral plate 75 and/or the magnetic disk 10 when aligning the position in the thickness direction of the magnetic disk 10 of the outer peripheral plate 75 and/or the magnetic disk 10 does not become longer than necessary. Therefore, the time of an alignment process of making the surface of the outer peripheral plate 75 and the surface of the magnetic disk 10 become flush with each other is sufficiently short, and thus high productivity is obtained.

In addition, in a case where the outer peripheral plate 75 and/or the magnetic disk 10 is movable in the above-described range, by adjusting the position of the outer peripheral plate 75 and/or the magnetic disk 10 by the alignment means, it is possible to eliminate a difference in level between the surfaces of the two.

Therefore, even if position deviation when installing the magnetic disk 10 and/or the outer peripheral plate 75 in the burnishing apparatus 20 or position deviation of the outer peripheral plate 75 due to repeatedly performing the burnishing occurs, it is possible to eliminate the position deviation.

Further, the burnishing apparatus 20 according to this embodiment is provided with measurement means (not shown) for measuring the positional relationship between the surface of the outer peripheral plate 75 and the surface of the magnetic disk 10 in the thickness direction of the outer peripheral plate 75. As the measurement means, it is preferable to use, for example, a non-contact type laser displacement meter or the like.

Further, it is preferable that the alignment means (the rotary support means 21 and the outer peripheral plate support means 78) move the outer peripheral plate 75 or the magnetic disk 10 in the thickness direction of the outer peripheral plate 75 on the basis of a measured result by the measurement means.

In addition, in this embodiment, the measurement means measures the positional relationship between the surface of the outer peripheral plate 75 and the surface of the magnetic disk 10 in the thickness direction of the outer peripheral plate 75 every time the magnetic disk 10 is supported on the rotary support means 21. It is preferable that the alignment means move the outer peripheral plate 75 or the magnetic disk 10 in the thickness direction of the outer peripheral plate 75 on the basis of a measured result by the measurement means, every time the magnetic disk 10 is supported on the rotary support means 21.

In addition, in this embodiment, a case where the rotary support means 21 and the outer peripheral plate support means 78 double as the alignment means has been taken and described as an example. Each of the rotary support means 21 and the outer peripheral plate support means 78 may be provided separately from the alignment means, and only one of the rotary support means 21 and the outer peripheral plate support means 78 may be made to double as the alignment means.

Further, the alignment means may be only one of the rotary support means 21 and the outer peripheral plate support means 78.

The tape moving means 22 is for relatively moving the polishing tapes 1*a* and 1*b* in a radial direction of the magnetic disk 10 while respectively pressing the polishing tapes 1*a* and 1*b* against the surfaces on both sides of the magnetic disk 10 which rotates.

In the burnishing apparatus 20 shown in FIGS. 3A, 3B, and 4A to 4E, the tape moving means 22 includes a pair of polishing tape pressing means 23*a* and 23*b* and a pair of polishing tape running systems 22*a* and 22*b*, each disposed to face each other so as to sandwich the magnetic disk 10 from both sides through each of the polishing tapes 1*a* and 1*b*, as shown in FIGS. 3A and 3B.

That is, the tape moving means 22 includes the first polishing tape running system 22*a* and the first polishing tape pressing means 23*a* disposed on one side across the magnetic disk 10, and the second polishing tape running system 22*b* and the second polishing tape pressing means 23*b* disposed on the other side.

The first polishing tape running system 22*a* includes a supply roll and a take-up roll (both of which are not shown), and a first guide roll 26, a second guide roll 27, a third guide roll 28, and a fourth guide roll 29 disposed below the supply roll and the take-up roll.

The first guide roll 26 to the fourth guide roll 29 are disposed such that each rotation axis is substantially parallel to the main surface 10*a* on one side of the magnetic disk 10 and the rotation axes are substantially parallel to each other. Then, the first guide roll 26 and the second guide roll 27 are disposed such that the distances between the first guide roll 26 and the second guide roll 27 and the main surface 10*a* on one side of the magnetic disk 10 are substantially the same. The third guide roll 28 and the fourth guide roll 29 are disposed such that the distances of the third guide roll 28 and the fourth guide roll 29 from the main surface 10*a* on one side of the magnetic disk 10 are substantially the same, at positions more away from the magnetic disk 10 than the first guide roll 26 and the second guide roll 27.

In the first polishing tape running system 22*a* configured in this manner, the long first polishing tape 1*a* is sequentially sent out from the supply roll. The first polishing tape 1*a* sent out from the supply roll runs following a substantially U-shaped running path while being guided by the first guide roll 26 to the fourth guide roll 29 and is then taken up on the take-up roll. Here, the first polishing tape 1*a* is in a state where the polishing surface S thereof faces the main surface 10*a* on one side of the magnetic disk 10, when running between the first guide roll 26 and the second guide roll 27.

On the other hand, the second polishing tape running system 22*b* includes a supply roll and a take-up roll (both of which are not shown), and a fifth guide roll 30, a sixth guide roll 31, a seventh guide roll 32, and an eighth guide roll 33 disposed below the supply roll and the take-up roll.

The fifth guide roll 30 to the eighth guide roll 33 are respectively disposed so as to be symmetrical with the first guide roll 26 to the fourth guide roll 29 across the magnetic disk 10.

In the second polishing tape running system 22*b* configured in this manner, the long second polishing tape 1*b* is sequentially sent out from the supply roll. The second polishing tape 1*b* sent out from the supply roll runs following a substantially U-shaped running path while being guided by the fifth guide roll 30 to the eighth guide roll 33 and is then taken up on the take-up roll. Here, the second polishing tape 1*b* is in a state where the polishing surface S thereof faces the main surface 10*b* on the other side of the magnetic disk 10, when running between the fifth guide roll 30 and the sixth guide roll 31.

The first polishing tape pressing means 23*a* is for relatively moving the first polishing tape 1*a* in the radial direction in the main surface of the magnetic disk 10 while pressing the first polishing tape 1*a* running between the first guide roll 26 and the second guide roll 27 to a side of the main surface 10*a* on one side of the magnetic disk 10, thereby bringing the first polishing tape 1*a* into contact with a side of the main surface 10*a* on one side of the magnetic disk 10 (pressing the first polishing tape 1*a* against a side of the main surface 10*a* on one side of the magnetic disk 10).

The second polishing tape pressing means 23*b* is for relatively moving the second polishing tape 1*b* in the radial direction in the main surface of the magnetic disk 10 while pressing the second polishing tape 1*b* running between the fifth guide roll 30 and the sixth guide roll 31 to a side of the main surface 10*b* on the other side of the magnetic disk 10, thereby bringing the second polishing tape 1*b* into contact with a side of the main surface 10*b* on the other side of the magnetic disk 10 (pressing the second polishing tape 1*b* against a side of the main surface 10*b* on the other side of the magnetic disk 10).

In this embodiment, the polishing tape pressing means 23*a* and 23*b* is made to be able to move the polishing tapes 1*a* and 1*b* in the radial direction of the magnetic disk 10. Therefore, it is possible to relatively move the polishing tapes 1*a* and 1*b* in the radial direction of the magnetic disk 10 by moving the polishing tape pressing means 23*a* and 23*b* in a state where the position of the magnetic disk 10 is fixed.

In addition, in this embodiment, the polishing tapes 1*a* and 1*b* are relatively moved in the radial direction of the magnetic disk 10 by moving the polishing tape pressing means 23*a* and 23*b* in a state where the position of the magnetic disk 10 is fixed. However, this is an example. A configuration is also acceptable in which the polishing tapes 1*a* and 1*b* are relatively moved in the radial direction of the magnetic disk 10 by using a configuration in which the magnetic disk 10 is movable, as the rotary support means 21, and moving the magnetic disk 10 along with the polishing tape pressing means 23*a* and 23*b*.

As the first polishing tape pressing means 23*a* and the second polishing tape pressing means 23*b*, it is preferable that portions coming into contact with the polishing tapes 1*a* and 1*b* be configured of a material having softness. In this way, it is possible to press the polishing surfaces S of the polishing tapes 1*a* and 1*b* against the surfaces of the magnetic disk 10 with good close-contact property, and thus it is possible to efficiently polish the surfaces of the magnetic disk 10. As such first polishing tape pressing means 23*a* and second polishing tape pressing means 23*b*, for example, pressing means configured so as to bring a pressing member such as a pad made of resin, a woven cloth, or the like, or a rubber roller into contact with the back surface of each of the polishing tapes and press the polishing tapes 1*a* and 1*b* to the magnetic disk 10 side, or the like can be given.

In the burnishing apparatus 20 shown in FIGS. 3A and 3B, the first polishing tape pressing means 23*a* and the second polishing tape pressing means 23*b* respectively have metal blocks 34 and 35, and pads 36 and 37, each mounted on the surface on one side of each of the metal blocks 34 and 35.

Further, the first polishing tape pressing means 23*a* and the second polishing tape pressing means 23*b* respectively have driving means (not shown) for reciprocating the metal blocks 34 and 35 in a direction perpendicular to each main surface of the magnetic disk and a direction parallel to each main surface of the magnetic disk.

The direction perpendicular to each main surface of the magnetic disk here refers to a horizontal direction, that is, a direction of an arrow F1 and a direction of an arrow F2 in FIGS. 3A and 3B. Further, the direction parallel to each main surface of the magnetic disk here refers to the radial direction of the magnetic disk 10, that is, a direction of an arrow F3 and a direction of an arrow F4 in FIG. 4A.

It is preferable that the tape moving means 22 separate the polishing tapes 1*a* and 1*b* from the magnetic disk 10 by moving the polishing tapes 1*a* and 1*b* onto the outer peripheral plate 75.

As a process of separating the polishing tapes 1*a* and 1*b* from the magnetic disk 10, specifically, for example, the following can be given. That is, first, the tape moving means 22 moves the polishing tapes 1*a* and 1*b* in the thickness direction of the magnetic disk 10 at a position close to the center of the magnetic disk 10, thereby starting pressing of the polishing tapes 1*a* and 1*b* against the surface of the magnetic disk 10. Thereafter, the polishing tapes 1*a* and 1*b* are relatively moved in the radial direction of the magnetic disk 10 toward the outside from the inside in the respective main surfaces of the magnetic disk 10. Then, the polishing tapes 1*a* and 1*b* are separated from the magnetic disk 10 by moving the entire polishing tapes 1*a* and 1*b* onto the outer peripheral plate 75. At this stage, the polishing tapes 1*a* and 1*b* are moved in the thickness direction of the magnetic disk 10, and thus pressing of the polishing tapes 1*a* and 1*b* against the surface of the outer peripheral plate 75 is finished.

Further, in this embodiment, the tape moving means 22 is made to relatively move the polishing tapes 1*a* and 1*b* in the radial direction of the magnetic disk 10 while pressing the polishing tapes 1*a* and 1*b* against the surfaces of the magnetic disk 10 which rotates, in a state where the polishing tapes 1*a* and 1*b* are disposed to face each other so as to sandwich the magnetic disk 10 from both sides. Therefore, compared to a case where the polishing tape is moved while being pressed against the magnetic disk 10 which rotates, from only the main surface 10*a* on one side, load from the polishing tape to the magnetic disk 10 is reduced and also it is possible to stably move the polishing tape.

In the burnishing apparatus 20 according to this embodiment, as shown in FIGS. 3A and 3B, a pair of jet nozzles 40 and 40 which applies liquid lubricants onto the polishing tapes is provided. Further, with respect to an installation place of the jet nozzle 40, it is not particularly limited, and it is possible to appropriately change the installation place according to a spatial limitation of the burnishing apparatus. In addition, the jet nozzles 40 and 40 are provided as necessary and need not be provided.

In addition, the burnishing apparatus according to the invention is not limited to the embodiment described above.

For example, the burnishing apparatus according to the invention may be an apparatus which performs the burnishing separately with respect to the main surface 10*a* on one side and the main surface 10*b* on the other side of the magnetic disk 10.

In this case, before the burnishing is performed on the main surface 10*a* on one side of the magnetic disk 10 and before the burnishing is performed on the main surface 10*b* on the other side of the magnetic disk 10, each time, the position in the thickness direction of the magnetic disk 10 of the outer peripheral plate and/or the magnetic disk is adjusted by the alignment means. Therefore, the thickness of the outer peripheral plate can be set regardless of the thickness of the magnetic disk 10.

Further, in the burnishing apparatus according to the invention, the polishing tape disposed on a side of the main surface 10*a* on one side of the magnetic disk 10 and the polishing tape disposed on a side of the main surface 10*b* on the other side may be disposed at positions which do not overlap when the magnetic disk 10 is viewed in a plan view. In this case, two outer peripheral plates, a outer peripheral plate for a side of the main surface 10*a* on one side of the magnetic disk 10 and a outer peripheral plate for a side of the main surface 10*b* on the other side, are disposed. The two outer peripheral plates are respectively disposed at a position corresponding to the movement of the polishing tapes. Therefore, the two outer peripheral plates are disposed at positions which do not overlap when the magnetic disk 10 is viewed in a plan view. For this reason, the thickness of each of the two outer peripheral plates can be set regardless of the thickness of the magnetic disk 10.

(Burnishing Method)

Next, the burnishing method according to the invention will be described.

The burnishing method according to the invention includes a substrate installation process of making the magnetic disk 10 be supported on the rotary support means 21 which rotatably supports the magnetic disk 10, and a burnishing process of relatively moving the polishing tapes 1*a* and 1*b* in the radial direction of the magnetic disk 10 while pressing the polishing surfaces S (in a case where liquid lubricant layers are provided, the surfaces thereof) of the polishing tapes 1*a* and 1*b* against the surfaces of the magnetic disk 10 which rotates.

In addition, an alignment process of adjusting the position in the thickness direction of the magnetic disk 10 of the outer peripheral plate 75 installed outside the outer peripheral end 10*c* of the magnetic disk 10 and/or the magnetic disk 10 so as to make the surface of the outer peripheral plate 75 and the surface of the magnetic disk 10 become flush with each other is provided between the substrate installation process and the burnishing process.

In this embodiment, the burnishing of a plurality of magnetic disks 10 is continuously performed one by one by repeatedly performing the substrate installation process a plurality of times, the alignment process, and the burnishing process in this order. That is, in the burnishing method according to this embodiment, first, after the magnetic disk which is not burnished is supported on the rotary support means 21, the alignment process is performed and the burnishing process is then performed. Thereafter, the magnetic disk after the processing is removed from the rotary support means 21, the magnetic disk before the burnishing is newly supported on the rotary support means 21, the alignment process is performed, and the burnishing process is then performed. Therefore, in the burnishing method according to this embodiment, every time the magnetic disk 10 is supported on the rotary support means 21, the alignment process is performed.

In the substrate installation process, chucking of the magnetic disk 10 to the spindle 24 is performed, whereby the magnetic disk 10 is mounted and supported on the magnetic disk retaining mechanism 25 of the rotary support means 21.

In this embodiment, before the substrate installation process is performed, the outer peripheral plate 75 is supported by the outer peripheral plate support means 78 in advance. The outer peripheral plate 75 is supported by the outer peripheral plate support means 78 so as to be disposed at a position on the outside of the outer peripheral end 10*c* of the magnetic disk 10 by making the magnetic disk 10 be supported on the rotary support means 21. Further, the outer peripheral plate 75 is installed at a position where the shortest distance between the outer peripheral end 10*c* of the magnetic disk 10 supported on the rotary support means 21 and the outer peripheral plate 75 is preferably, as short as not to touch each other and less than or equal to 10 mm, more preferably, less than or equal to 5 mm, most preferably, less than or equal to 2 mm.

The alignment process can be performed, for example, by fixing the magnetic disk 10 and moving the outer peripheral plate 75 in the thickness direction (the direction of the arrow C shown in FIG. 4A) of the outer peripheral plate 75 by the outer peripheral plate support means 78.

Figure 4A:
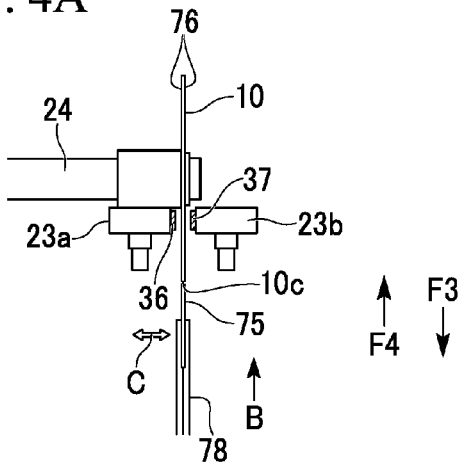
FIGS. 4A to 4E are enlarged horizontal cross-sectional schematic diagrams when the burnishing apparatus shown in FIGS. 3A and 3B is viewed from a direction of an arrow A shown in FIG. 3A.

In addition, in the alignment process, a burnished surface 76 of the magnetic disk 10 may be moved in the direction of the arrow C shown in FIG. 4A by the rotary support means 21 with the outer peripheral plate 75 fixed, and both the outer peripheral plate 75 and the burnished surface 76 may also be moved in the direction of the arrow C shown in FIG. 4A.

In any case, the positional relationship between the surface of the outer peripheral plate 75 and the surface of the magnetic disk 10 in the thickness direction of the outer peripheral plate 75 is measured by measuring the position of the surface of the outer peripheral plate 75 and/or the surface of the burnished surface 76 of the magnetic disk 10 by the measurement means which is, for example, a non-contact type laser displacement meter. Then, based on the result of the measurement, it is preferable to perform alignment such that the surface of the outer peripheral plate 75 and the surface of the magnetic disk 10 become flush with each other.

In addition, the measurement of the positional relationship between the surface of the outer peripheral plate 75 and the surface of the magnetic disk 10 by the measurement means may be performed before the alignment process, may also be performed after the alignment process, and may also be performed before and after the alignment process.

Further, a process of replacing the outer peripheral plate 75 may be performed on the basis of the result of the measurement of the positional relationship between the surface of the outer peripheral plate 75 and the surface of the magnetic disk 10 by the measurement means. In the burnishing apparatus 20 according to this embodiment, since the outer peripheral plate 75 is detachably supported by the outer peripheral plate support means 78, the outer peripheral plate 75 can be easily replaced.

It is preferable that the process of replacing the outer peripheral plate 75 be performed in a case where even if the alignment process is performed, it is determined that the surface of the outer peripheral plate 75 and the surface of the magnetic disk 10 do not become flush with each other, on the basis of the result of the measurement.

In addition even if the alignment process is performed, the surface of the outer peripheral plate 75 and the surface of the magnetic disk 10 do not become flush with each other, which means it is a case of exceeding a range in which the outer peripheral plate 75 and/or the magnetic disk 10 can be moved by the alignment means.

For example, in this embodiment, a case is assumed where the outer peripheral plate support means 78 and the rotary support means 21 can move the outer peripheral plate 75 and/or the magnetic disk 10 in a range of ±45 μm, that is, greater than or equal to −45 μm and less than or equal to 45 μm in the thickness direction of the magnetic disk 10.

In this case, as a result of the measurement by the measurement means, if position deviation in the thickness direction of the outer peripheral plate 75 between the surface of the outer peripheral plate 75 and the surface of the magnetic disk 10 is less than −45 μm or exceeds 45 μm, it is determined that the surface of the outer peripheral plate 75 and the surface of the magnetic disk 10 do not become flush with each other.

For example, a case is assumed where the position of the outer peripheral plate 75 is greatly deviated from a predetermined position due to occurrence of wear, degradation, or deformation of the outer peripheral plate 75 or occurrence of loosening of the outer peripheral plate support means 78 by continuously performing the burnishing of a plurality of magnetic disks 10 one by one. Even in such a case, by performing the process of replacing the outer peripheral plate 75, it is possible to prevent the contamination of the magnetic disk 10 due to falling-off or crushing of the abrasive grains from the polishing tapes 1*a* and 1*b*.

In addition, in this embodiment, it is preferable that the measurement of the positional relationship between the surface of the outer peripheral plate 75 and the surface of the magnetic disk 10 by the measurement means be performed again after the process of replacing the outer peripheral plate 75 is performed, and on the basis of the result, the alignment process is performed and the burnishing process is then performed.

In the burnishing process, first, the first polishing tape 1*a* and the second polishing tape 1*b* are respectively put over the first polishing tape running system 22*a* and the second polishing tape running system 22*b*.

In addition, as shown in FIGS. 3A and 4A, in the burnishing apparatus 20, in the initial state, the respective pad 36 and 37 of the first polishing tape pressing means 23*a* and the second polishing tape pressing means 23*b* are at positions away from the polishing tapes 1*a* and 1*b* and are in a standby state.

Next, if an operation of each section is turned on, the magnetic disk rotational drive mechanism (the rotary support means) 21 rotationally drives the magnetic disk 10 in the direction of the arrow r in FIG. 3A. Further, the respective supply rolls respectively sequentially send out the first polishing tape 1*a* and the second polishing tape 1*b*. The first polishing tape 1*a* sent out runs following the substantially U-shaped running path while being guided by the first guide roll 26 to the fourth guide roll 29 and is then taken up on the take-up roll. Further, the second polishing tape 1*b* sent out runs following the substantially U-shaped running path while being guided by the fifth guide roll 30 to the eighth guide roll 33 and is then taken up on the take-up roll.

At this time, the first polishing tape 1*a* running between the first guide roll 26 and the second guide roll 27 runs in the opposite direction to the scanning direction of the track of the magnetic disk 10 with the polishing surface S thereof facing the main surface 10*a* on one side of the magnetic disk 10.

Further, the second polishing tape 1*b* running between the fifth guide roll 30 and the sixth guide roll 31 runs in the opposite direction to the scanning direction of the track of the magnetic disk 10 with the polishing surface S thereof facing the main surface 10*b* on the other side of the magnetic disk 10.

Next, as shown in FIGS. 3A and 4A, the first polishing tape pressing means 23*a* presses the first polishing tape 1*a* running between the first guide roll 26 and the second guide roll 27 to a side of the main surface 10*a* on one side of the magnetic disk 10, thereby bringing the polishing surface S of the polishing tape 1*a* into contact with the main surface 10*a* on one side of the magnetic disk 10 (pressing the polishing surface S of the polishing tape 1*a* against the main surface 10*a* on one side of the magnetic disk 10). Further, the second polishing tape pressing means 23*b* presses the second polishing tape 1*b* running between the fifth guide roll 30 and the sixth guide roll 31 to a side of the main surface 10*b* on the other side of the magnetic disk 10, thereby bringing the polishing surface S of the polishing tape 1*b* into contact with the main surface 10*b* on the other side of the magnetic disk 10 (pressing the polishing surface S of the polishing tape 1*b* against the main surface 10*b* on the other side of the magnetic disk 10).

In addition, in the polishing tape pressing means 23*a* and 23*b*, the driving means moves the metal blocks 34 and 35 in the direction of the arrow F1 in FIGS. 3A and 3B in a state where the pads 36 and 37 are respectively separated from the polishing tapes 1*a* and 1*b* (the standby state). In this way, the pads 36 and 37 respectively come into contact with the back surfaces of the polishing tapes 1*a* and 1*b* and press the polishing tapes 1*a* and 1*b* to the magnetic disk 10 side.

Figure 4B:
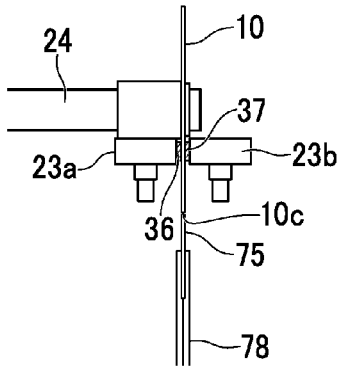
Figure 4D:
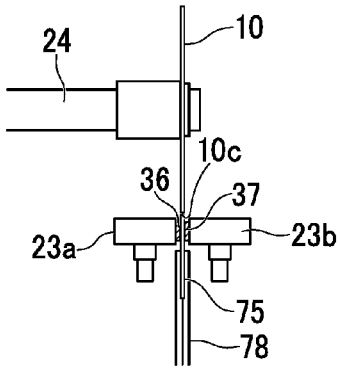

As a result, as shown in FIGS. 3B and 4B, the polishing surfaces S (refer to FIG. 3A) of the polishing tapes 1*a* and 1*b* come into contact with the main surfaces 10*a* and 10*b* of the magnetic disk 10 which is rotationally driven in the direction of the arrow r in FIG. 3B, at the positions close to the center of the magnetic disk 10, and pressing of the polishing tapes 1*a* and 1*b* against the surfaces of the magnetic disk 10 is started. In this way, the main surface 10*a* on one side and the main surface 10*b* on the other side of the magnetic disk 10 are respectively slid by the polishing surface S of the first polishing tape 1*a* and the polishing surface S of the second polishing tape 1*b*, and the burnishing process is started.

Figure 4C:
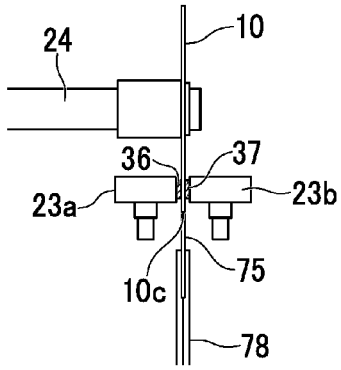

Thereafter, the polishing tapes 1*a* and 1*b* are moved in the radial direction (the direction of the arrow F3 in FIG. 4A) of the magnetic disk 10 toward the outside from the inside of each main surface of the magnetic disk 10 while pressing the polishing tapes 1*a* and 1*b* against the main surfaces 10*a* and 10*b* of the magnetic disk 10 (refer to FIG. 4C).

Figure 4E:
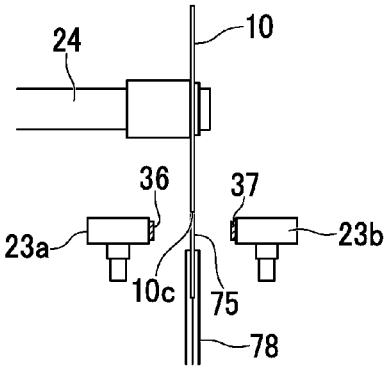
Figure 5:
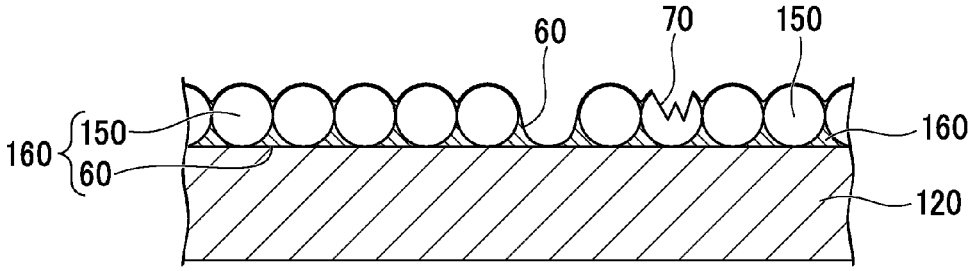
FIG. 5 is an enlarged cross-sectional view showing an example of a polishing tape which is used in burnishing.
Figure 6A:
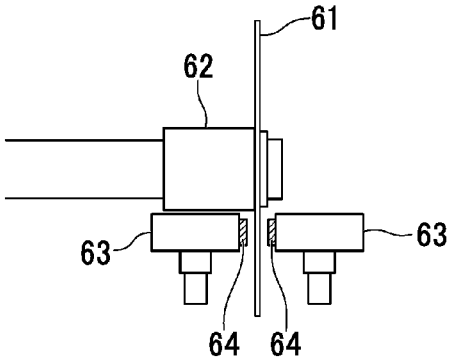
FIGS. 6A to 6D are enlarged schematic diagrams showing a cross-sectional structure of a burnishing apparatus of the related art which is used in burnishing.
Figure 6B:
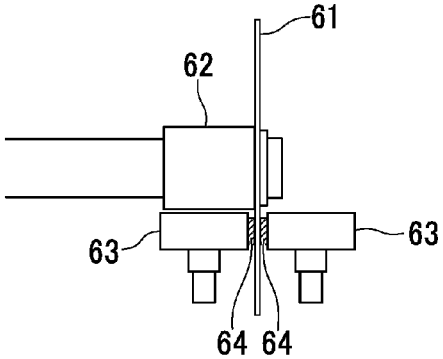
Figure 6C:
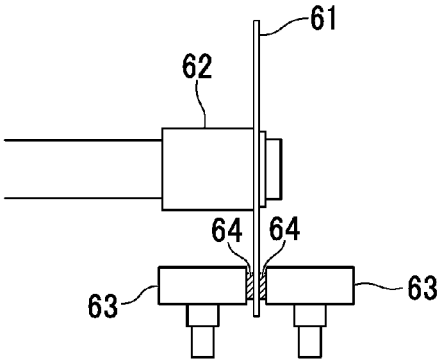
Figure 6D:
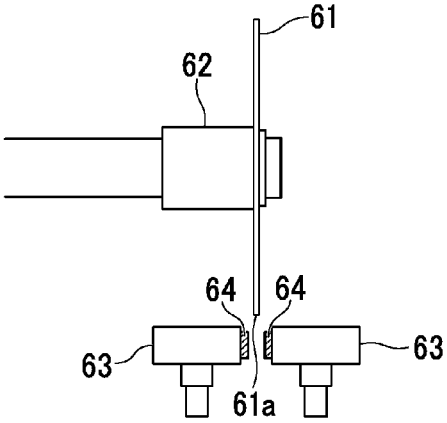

Then, at the stage where the entire polishing tapes 1*a* and 1*b* have been moved onto the outer peripheral plate 75 (refer to FIG. 4D), the polishing tapes 1*a* and 1*b* are separated from the magnetic disk 10. Then, if the metal blocks 34 and 35 are moved in the direction of the arrow F2 in FIGS. 3A and 3B, the polishing tapes 1*a* and 1*b* are separated from the outer peripheral plate 75 and the pads 36 and 37 are separated from the polishing tapes 1*a* and 1*b*, as shown in FIG. 4E.

Thereafter, in a state where the polishing tapes 1*a* and 1*b* have been separated from the magnetic disk 10, the polishing tapes 1*a* and 1*b* are moved in the radial direction (the direction of the arrow F4 in FIG. 4A) of the magnetic disk 10 toward the inside from the outside of each main surface of the magnetic disk 10. In this way, the polishing tape pressing means 23*a* and 23*b* returns to the standby state shown in FIGS. 3A and 4A.

In this embodiment, by performing the burnishing process, projections which are present on both main surfaces of the magnetic disk 10 are polished and removed by the polishing action of the respective polishing tape 1*a* and 1*b* and both main surfaces are smoothed.

In addition, in the burnishing process, it is preferable to separate the polishing tapes 1*a* and 1*b* from the magnetic disk 10 by moving the polishing tapes 1*a* and 1*b* onto the outer peripheral plate 75. In this way, the projections removed from the magnetic disk 10 by the burnishing process can be prevented from remaining on the magnetic disk 10.

Further, in the burnishing process, the liquid lubricants may be jetted from the jet nozzles 40 to be applied onto the polishing tapes 1*a* and 1*b*.

The burnishing apparatus 20 according to this embodiment includes the rotary support means 21 for rotatably supporting the magnetic disk 10, and the outer peripheral plate 75 disposed at a position on the outside of the outer peripheral end 10*c* of the magnetic disk 10 supported on the rotary support means 21. Further, the burnishing apparatus 20 according to this embodiment includes the tape moving means 22 for relatively moving the polishing tapes 1*a* and 1*b* in the radial direction of the magnetic disk 10 while pressing the polishing tapes 1*a* and 1*b* against the surfaces of the magnetic disk 10 which rotates. Further, the burnishing apparatus 20 according to this embodiment includes the alignment means for adjusting the position in the thickness direction of the magnetic disk 10 of the outer peripheral plate 75 and/or the magnetic disk 10 so as to make the surface of the outer peripheral plate 75 and the surface of the magnetic disk 10 become flush with each other. The outer peripheral plate support means 78 and the rotary support means 21 double as the alignment means. Due to such a configuration, by using the burnishing method according to this embodiment in which the alignment process is performed between the substrate installation process and the burnishing process, it is possible to perform the burnishing with high yield while suppressing the contamination of the magnetic disk 10 by falling-off or crushing of the abrasive grains from the polishing tapes 1*a* and 1*b*.

Further, the burnishing method according to this embodiment includes the substrate installation process of making the magnetic disk 10 be supported on the rotary support means for rotatably supporting the magnetic disk 10, and the burnishing process of relatively moving the polishing tapes 1*a* and 1*b* in the radial direction of the magnetic disk 10 while pressing the polishing tapes 1*a* and 1*b* against the surfaces of the magnetic disk 10 which rotates.

In addition, the burnishing method according to this embodiment includes the alignment process of making the surface of the outer peripheral plate 75 and the surface of the magnetic disk 10 become flush with each other, between the substrate installation process and the burnishing process. The alignment is performed to adjust the position in the thickness direction of the magnetic disk 10 of the outer peripheral plate 75 installed outside the outer peripheral end 10*c* of the magnetic disk 10 and/or the magnetic disk 10.

In this way, the burnishing is performed in a state where the surface of the outer peripheral plate 75 and the surface of the magnetic disk 10 are flush with each other.

For this reason, in the burnishing method according to this embodiment, in the burnishing process, the polishing tapes 1*a* and 1*b* are pressed against the surface of the outer peripheral plate 75 which is flush with the surface of the magnetic disk 10, as well as the outer peripheral end 10*c* of the magnetic disk 10. Therefore, substantially uniform forces are loaded to a portion pressed against the outer peripheral end 10*c* of the magnetic disk 10 in each of the polishing tapes 1*a* and 1*b* and a portion pressed against the outer peripheral plate 75 in each of the polishing tapes 1*a* and 1*b*. As a result, it is possible to effectively prevent falling-off or crushing of the abrasive grains due to a strong force being applied to a portion of each of the polishing tapes 1*a* and 1*b*.

Therefore, according to the burnishing method according to this embodiment, it is possible to perform the burnishing with high yield while suppressing the contamination of the magnetic disk 10 due to falling-off or crushing of the abrasive grains from the polishing tapes 1*a* and 1*b*, and the magnetic disk 10 having excellent surface smoothness can be obtained.

Further, the magnetic disk 10 obtained after the burnishing has excellent surface smoothness. Therefore, even in a case where the magnetic disk 10 is applied to a magnetic recording and reproducing apparatus (a hard disk drive) in which the flying height of the magnetic head is minute, a collision of the magnetic head with the magnetic disk 10 is suppressed and good operating characteristics are obtained.

In addition, in this embodiment, by using a polishing tape with the liquid lubricant layer 4 (refer to FIG. 1) applied thereto as the polishing tape 1, crushing of the abrasive grains 5 which are included in the abrasive grain layer 3 or falling-off of the crushed grains is even more suppressed, and thus the contamination of the magnetic disk 10 is more effectively suppressed.

(Magnetic Recording and Reproducing Apparatus)

Next, an example of the magnetic recording and reproducing apparatus to which the magnetic disk processed by the burnishing method according to the invention is applied will be described.

Figure 7:
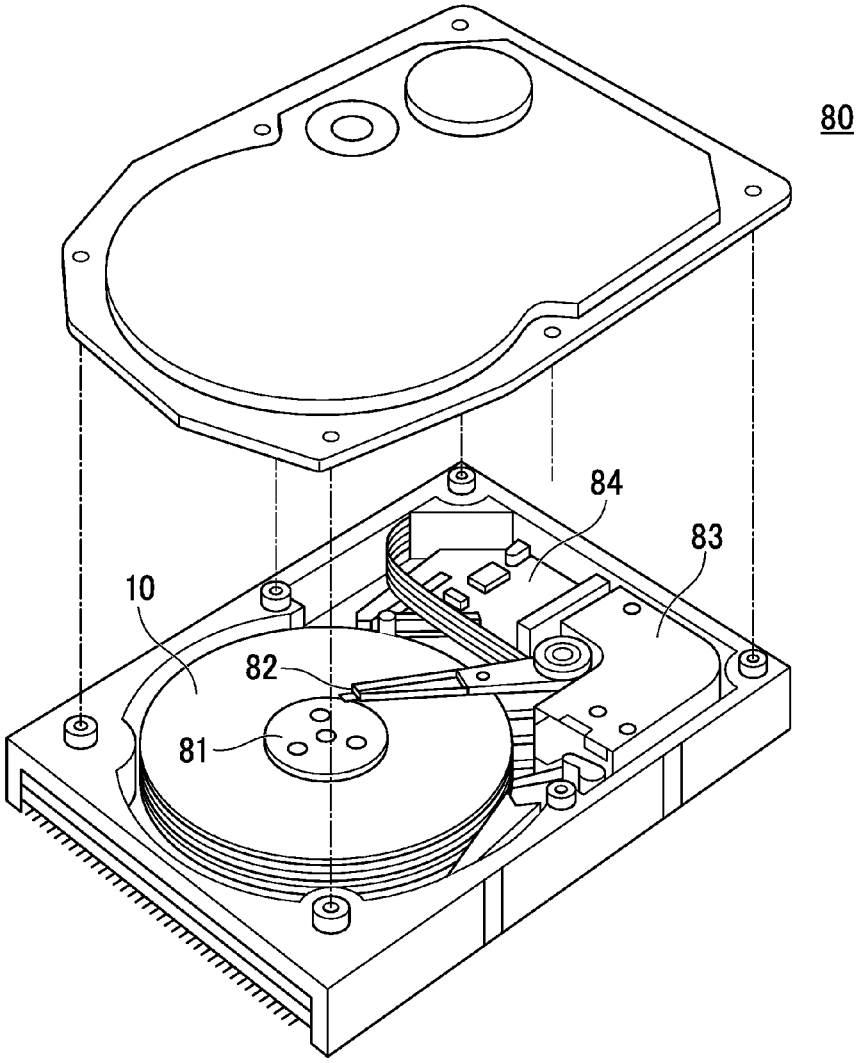
FIG. 7 is a schematic configuration diagram showing an example of a magnetic recording and reproducing apparatus.

FIG. 7 is a schematic configuration diagram showing an example of the magnetic recording and reproducing apparatus. A magnetic recording and reproducing apparatus 80 shown in FIG. 7 includes the magnetic disk 10 processed by the burnishing method according to the invention, a medium drive section 81 which rotationally drives the magnetic disk 10, a magnetic head 82 which records information on the magnetic disk 10 and also reproduces the recorded information, a head drive section 83 which relatively moves the magnetic head 82 with respect to the magnetic disk 10, and a recording and reproducing signal processing system 84. The recording and reproducing signal processing system 84 processes the input data and sends the obtained recording signal to the magnetic head 82, and also processes a reproducing signal from the magnetic head 82 and outputs the obtained data.

The magnetic recording and reproducing apparatus 80 shown in FIG. 7 is provided with the magnetic disk 10 obtained by the burnishing method according to the invention which uses the burnishing apparatus according to the invention. For this reason, the smoothness of the surface of the magnetic disk 10 is high and furthermore, the cleanliness of the surface is high. Therefore, even if the flying height of the magnetic head 82 is minute, collision of the magnetic head 82 with the magnetic disk 10 is suppressed, and thus high recording density and reliability can be obtained.

EXAMPLES

Example

An example for demonstrating the invention will be described below. However, the invention is not limited only to the example.

[Manufacturing of Magnetic Disk]

A glass substrate (manufactured by HOYA Corporation, outer shape: 2.5 inches) which has been cleaned was accommodated in a film formation chamber of a DC magnetron sputtering apparatus (C-3040 manufactured by ANELVA Corporation) and the film formation chamber was evacuated to ultimate vacuum of $1\times10^{-5}$ Pa.

Thereafter, a close-contact layer having a thickness of 10 nm was formed on the glass substrate by using a Cr target by a sputtering method.

Next, a soft magnetic foundation layer was formed on the close-contact layer at a substrate temperature of less than or equal to 100° C. by using a target of Co-20Fe-5Zr-5Ta {Fe content: 20 atomic %, Zr content: 5 atomic %, Ta content: 5 atomic %, and the remainder: Co} by a sputtering method. The soft magnetic foundation layer is a layer in which a first soft magnetic layer having a layer thickness of 25 nm, an intermediate layer made of Ru having a layer thickness of 0.7 nm, and a second soft magnetic layer made of Co-20Fe-5Zr-5Ta having a layer thickness of 25 nm are laminated in order from the glass substrate side.

Next, a seed layer having a layer thickness of 5 nm was formed on the soft magnetic foundation layer by using a Ni-6W {W content: 6 atomic %, and the remainder: Ni} target by a sputtering method.

Thereafter, as a first orientation control layer, a Ru layer having a layer thickness of 10 nm was formed on the seed layer under sputtering pressure of 0.8 Pa by a sputtering method. Next, as a second orientation control layer, a Ru layer having a layer thickness of 10 nm was formed on the first orientation control layer under sputtering pressure of 1.5 Pa by a sputtering method.

Subsequently, a first magnetic layer having a layer thickness of 9 nm was formed on the second orientation control layer under sputtering pressure of 2 Pa by a sputtering method. The first magnetic layer is made of 91(Co15Cr16Pt)-6($SiO_2$)-3($TiO_2$) {containing 91 mol % of an alloy of Cr content 15 atomic %, Pt content 16 atomic %, and the remainder Co, 6 mol % of an oxide made of $SiO_2$, and 3 mol % of an oxide made of $TiO_2$}.

Next, a nonmagnetic layer made of 88(Co30Cr)-12($TiO_2$) {containing 88 mol % of an alloy of Cr content 30 atomic % and the remainder Co and 12 mol % of an oxide made of $TiO_2$} was formed on the first magnetic layer so as to have a layer thickness of 0.3 nm by a sputtering method.

Thereafter, a second magnetic layer having a layer thickness of 6 nm was formed on the nonmagnetic layer under sputtering pressure of 2 Pa by a sputtering method. The second magnetic layer is made of 92(Co11Cr18Pt)-5($SiO_2$)-3($TiO_2$) {containing 92 mol % of an alloy of Cr content 11 atomic %, Pt content 18 atomic %, and the remainder Co, and $SiO_2$}.

Thereafter, a nonmagnetic layer made of Ru was formed on the second magnetic layer so as to have a layer thickness of 0.3 nm by a sputtering method.

Next, a third magnetic layer was formed on the nonmagnetic layer so as to have a layer thickness of 7 nm under sputtering pressure of 0.6 Pa by using a target made of Co-20Cr-14Pt-3B {Cr content: 20 atomic %, Pt content: 14 atomic %, B content: 3 atomic %, and the remainder: Co} by a sputtering method.

Next, a protective layer made of a carbon film having a layer thickness of 3 nm was formed by a CVD method and finally, a lubricant layer made of perfluoropolyether was formed by a dipping method, whereby, a magnetic disk was fabricated.

[Burnishing]

Burnishing was performed on 1000 magnetic disks manufactured as described above, by using the burnishing apparatus shown in FIGS. 3A, 3B, and 4A to 4E.

In addition, the number of rotations of the magnetic disk was set to be 300 rpm, the feed rate of the polishing tape was set to be 10 mm/second, a pressing force when pressing the polishing tape against the magnetic disk was set to be 98 mN, and treatment time was set to be 5 seconds. Further, after chucking of the magnetic disk to the spindle of the burnishing apparatus has been performed (the substrate installation process), fine adjustment (the alignment process) of the position of the outer peripheral plate was performed by the outer peripheral plate support means (the alignment means) such that the surface of the outer peripheral plate and the surface of the magnetic disk become flush with each other. The distance between the outer peripheral end of the outer peripheral plate and the outer peripheral end of the magnetic disk was set to be 1.5 mm. Then, the burnishing process of moving the polishing tape in the radial direction of the magnetic disk while pressing the polishing tape against the surface of the magnetic disk which rotates, was performed.

In addition, as the outer peripheral plate support means in the burnishing apparatus, support means was used which moves the outer peripheral plate in the thickness direction of the outer peripheral plate by a pulse motor on the basis of a measured result by a non-contact type laser displacement meter (the measurement means). In the outer peripheral plate support means used here, a movable range of the outer peripheral plate in a case where travel time of the outer peripheral plate is within 0.5 seconds was ±0.5 mm, that is, greater than or equal to −0.5 mm and less than or equal to 0.5 mm. Further, in the outer peripheral plate support means used here, positioning accuracy (a range of position deviation in the thickness direction of the magnetic disk between the surface of the outer peripheral plate and the surface of the magnetic disk after the alignment process) was ±0.5 μm, that is, greater than or equal to −0.5 μm and less than or equal to 0.5 μm with the apparatus accuracy. Then, the substrate installation process, the alignment process, and the burnishing process were repeatedly performed 1000 times in this order.

Further, a range of a distance of moving the position of the outer peripheral plate during the processing of 1000 magnetic disks was ±45 μm, that is, greater than or equal to −45 μm and less than or equal to 45 μm. Further, as the polishing tape, a tape made by forming an alumina abrasive layer on a base film made of polyester, AWA10000 manufactured by Nihon Micro Coating Co., Ltd., was used.

Comparative Example

The burnishing was performed in the same manner as in the example. However, positioning of the outer peripheral plate was performed at only the first of the processing of 1000 magnetic disks.

[Evaluation of Contamination Situation]

With respect to each magnetic disk of the example and the comparative example, in which the burnishing was performed, a contamination situation was evaluated by using a tester (a surface testing device). The contamination situation was evaluated by measuring the number of magnetic disks in which piercing of a crushed alumina grain (having a size of about 0.5 μm) or sticking (of a grain having a grain size of greater than or equal to 0.5 μm) was observed.

As a result of the evaluation of the contamination situation, in the magnetic disk on which the burnishing was performed by the method of the example, the number of magnetic disks in which contamination was observed was two.

In contrast to this, in the magnetic disk on which the burnishing was performed by the method of the comparative example, the number of magnetic disks in which contamination was observed was fifteen.

In this manner, in the magnetic disk on which the burnishing was performed by the example, occurrence of contamination by the crushed alumina grains was small, compared to the magnetic disk on which the burnishing was performed by the comparative example.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A burnishing method comprising:

a substrate installation process of making a magnetic disk be supported on rotary support means for rotatably supporting the magnetic disk; and a burnishing process of starting pressing of a polishing tape against a surface of the magnetic disk and relatively moving the polishing tape in a radial direction of the magnetic disk toward an outer peripheral end of the magnetic disk while pressing the polishing tape against the surfaces of the magnetic disk which rotates, wherein an alignment process of adjusting the position of an outer peripheral plate installed outside the outer peripheral end of the magnetic disk and/or the magnetic disk in a thickness direction of the magnetic disk so as to make the surface of the outer peripheral plate and the surface of the magnetic disk become flush with each other is performed between the substrate installation process and the burnishing process.

2. The burnishing method according to claim 1, wherein burnishing of a plurality of magnetic disks is continuously performed one by one by repeatedly performing the substrate installation process a plurality of times, the alignment process, and the burnishing process in this order.

3. The burnishing method according to claim 1, wherein in the burnishing process, the polishing tape is separated from the magnetic disk by moving the polishing tape onto the outer peripheral plate.

4. A burnishing apparatus comprising:

rotary support means for rotatably supporting a magnetic disk;

an outer peripheral plate disposed at a position on the outside of an outer peripheral end of the magnetic disk supported on the rotary support means;

tape moving means for starting pressing of a polishing tape against a surface of the magnetic disk and relatively moving the polishing tape in a radial direction of the magnetic disk toward the outer peripheral end of the magnetic disk while pressing the polishing tape against the surface of the magnetic disk which rotates; and alignment means for adjusting the position in a thickness direction of at least one of the magnetic disk of the outer peripheral plate and the magnetic disk so as to make the surface of the outer peripheral plate and the surface of the magnetic disk become flush with each other.

5. The burnishing apparatus according to claim 4, wherein the alignment means adjusts the position in the thickness direction of at least one of the magnetic disk of the outer peripheral plate and the magnetic disk every time the magnetic disk is supported on the rotary support means.

6. The burnishing apparatus according to claim 4, wherein the alignment means moves the outer peripheral plate and/or the magnetic disk in a range of ±45 μm in the thickness direction of the magnetic disk so as to make the surface of the outer peripheral plate and the surface of the magnetic disk become flush with each other.

7. The burnishing apparatus according to claim 4, wherein the surface of the outer peripheral plate is formed of any of glass, stainless steel, and a ceramic material, each having the same roughness as the magnetic disk.

8. The burnishing apparatus according to claim 4, wherein the outer peripheral plate is detachably supported.

9. The burnishing apparatus according to claim 4, wherein the outer peripheral plate is disposed at a position where the shortest distance between the outer peripheral plate and the outer peripheral end of the magnetic disk is less than or equal to 10 mm.

10. The burnishing apparatus according to claim 4, wherein the tape moving means includes a pair of polishing tape pressing means and a pair of polishing tape running systems, each disposed to face each other so as to sandwich the magnetic disk from both sides through the polishing tape.

11. A burnishing method comprising:

a substrate installation process of making a magnetic disk be supported on rotary support means for rotatably supporting the magnetic disk; and a burnishing process of starting pressing of a polishing tape against a surface of the magnetic disk and relatively moving the polishing tape in a radial direction of the magnetic disk toward an outer peripheral end of the magnetic disk while pressing the polishing take against the surfaces of the magnetic disk which rotates, wherein an alignment process of adjusting the position of an outer peripheral plate installed outside the outer peripheral end of the magnetic disk and/or the magnetic disk in a thickness direction of the magnetic disk so as to make the surface of the outer peripheral and the surface of the magnetic disk become flush with each other is performed between the substrate installation process and the burnishing process, wherein burnishing of a plurality of magnetic disks is continuously performed one by one by repeatedly performing the substrate installation process a plurality of times, the alignment process, and the burnishing process in this order, and in the burnishing process, the polishing tape is separated from the magnetic disk by moving the polishing tape onto the outer peripheral plate.

12. A burnishing apparatus comprising:

rotary support means for rotatably supporting a magnetic disk;

an outer peripheral plate disposed at a position on the outside of an outer peripheral end of the magnetic disk supported on the rotary support means;

tape moving means for starting pressing of a polishing tape against a surface of the magnetic disk and relatively moving a polishing tape in a radial direction of the magnetic disk toward the outer peripheral end of the magnetic disk while pressing the polishing tape against the surface of the magnetic disk which rotates; and alignment means for adjusting the position in a thickness direction of at least one of the magnetic disk of the outer peripheral plate and the magnetic disk so as to make the surface of the outer peripheral plate and the surface of the magnetic disk become flush with each other, wherein the alignment means adjusts the position in the thickness direction of at least one of the magnetic disk of the outer peripheral plate and the magnetic disk every time the magnetic disk is supported on the rotary support means, and the alignment means moves the outer peripheral plate and/or the magnetic disk in a range of ±45 μm in the thickness direction of the magnetic disk so as to make the surface of the outer peripheral plate and the surface of the magnetic disk become flush with each other.

* * * * *